United States Patent [19]

Verna

[11] 4,386,542

[45] Jun. 7, 1983

[54] GRIPPING TOOL

[76] Inventor: Louis R. Verna, 41 Brookside Dr., Holland, Pa. 18966

[21] Appl. No.: 189,230

[22] Filed: Sep. 22, 1980

[51] Int. Cl.[3] ..... B25B 7/02

[52] U.S. Cl. ..... 81/420; 81/425 R

[58] Field of Search ..... 81/418–428 R, 81/369; 269/257

[56] References Cited

U.S. PATENT DOCUMENTS

| | | | |
|---|---|---|---|
| 2,990,863 | 7/1961 | Pantermoller | 81/418 |
| 3,253,850 | 5/1960 | Trusty | 81/428 R |
| 3,842,696 | 10/1974 | Wayne | 81/425 R |
| 4,181,392 | 1/1980 | Casler et al. | 269/257 |

*Primary Examiner*—James L. Jones, Jr.

*Attorney, Agent, or Firm*—Walter B. Udell

[57] ABSTRACT

A locking plier type of device which is provided with very large gripping jaw surfaces movable into face to face apposition, with each being provided with arcuately curved rows of arcuate teeth or serrations which interfit with one another when the jaws are brought together. The arcuate teeth or serrations are angled so that oppositely directed pulls on the tool and the sheet metal clamped between the jaws of the tool tends to cause the serrations to penetrate slightly into the surface of the sheet metal to thereby increase the grip of the tool on the sheet metal. Platen type jaws on the order of an inch and three eighths to an inch and a half square produce quite satisfactory results and permit the exertion of very strong pulling forces on sheet metal panels of substantial size.

7 Claims, 6 Drawing Figures

GRIPPING TOOL

This invention relates generally to gripping tools and more particularly relates to gripping tools having specific applications for use with sheet metal work, as for example in connection with automobile body repair.

In the past, various devices have been used to grip portions of distorted sheet metal panels to try to pull bends and wrinkles out which have resulted from damaging impact. Unfortunately, in many cases the gripping abilities of the various devices which have heretofore been available have been inadequate, with the consequent result that the gripping tool would slip out of engagement with the sheet metal so that the desired pulling and straightening of the panel could not be properly effected. This resulted in either the necessity to replace the entire panel or a substantial amount of hammering out of the panel and subsequent filling with plastic material, such as body paste, to restore the desired contour to the sheet metal part. The gripping tool according to the invention eliminates the problems involved by providing a positive grip to the sheet metal without danger of slippage, and permits the application of very strong pulling forces on the sheet metal to straighten the same without danger that the gripping tool will detach itself from the sheet metal and fly about at dangerously high speeds which could cause severe injury to a worker who might be struck by the rapidly moving tool.

The gripping tool according to the invention overcomes these deficiencies in the prior art by providing a locking plier type of device which is provided with very large gripping jaw surfaces movable into face to face apposition, with each being provided with arcuately curved rows of arcuate teeth or serrations which interfit with one another when the jaws are brought together. The arcuate teeth or serrations are angled so that oppositely directed pulls on the tool and the sheet metal clamped between the jaws of the tool tends to cause the serrations to penetrate slightly into the surface of the sheet metal to thereby increase the grip of the tool on the sheet metal. The apposed jaws of the tool may be made of any convenient size but it has been found that platen type jaws on the order of an inch and three eighths to an inch and a half square produce quite satisfactory results and permit the exertion of very strong pulling forces on sheet metal panels of substantial size.

It is a primary object of the invention to provide a novel gripping tool of the locking plier type having large platen like jaws provided with arcuately curved teeth or serrations in which the chords of the arcuate serrations are oriented transversely to the direction of the pulling force applied to the gripping tool.

Another object of the invention is to provide a novel gripping tool as aforesaid wherein the gripping teeth or serrations are angled transversely to the gripped material at an acute angle so that oppositely directed pulls exerted on the sheet material and the tool cause the teeth or serrations to tend to dig into the sheet material being gripped.

A further object of the invention is to provide a novel gripping tool as aforesaid wherein the arcuate teeth or serrations on one platen or jaw of the tool interfit into the spaces between the teeth or serrations on the other platen of the tool when the two platens are brought into apposition with one another.

The foregoing and other objects of the invention will become clear from a reading of the following specification in conjunction with an examination of the appended drawings, wherein.

In the several figures, like elements are denoted by like reference characters.

Figure 1:
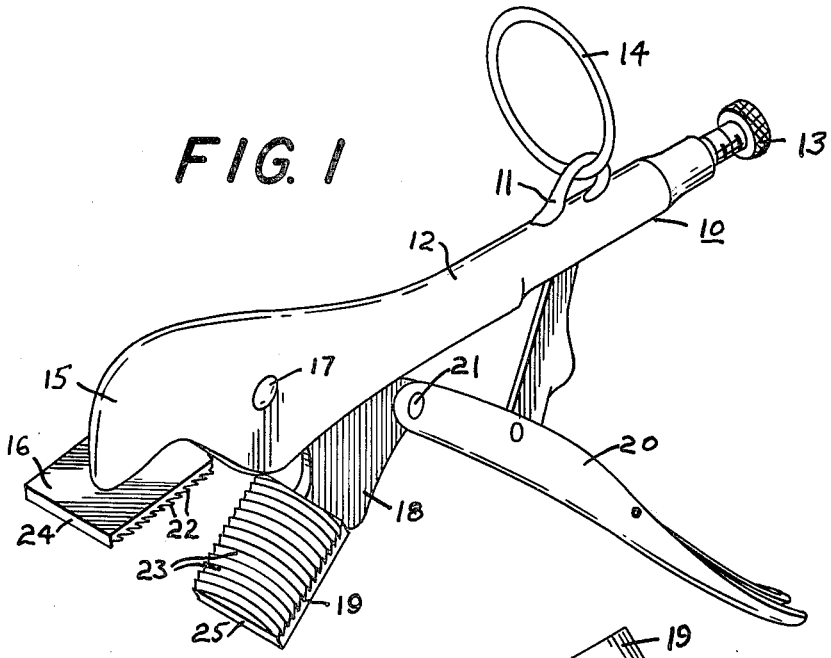
FIG. 1 is an isometric view of the gripping tool according to the invention with the tool shown in jaws open position.

Referring now to the drawings, there is seen a tool designated generally as 10, which tool is of the locking plier type having an eye 11 fixedly secured to the arm 12 of the tool which contains the adjusting bolt 13. Secured through the eye 11 is a pulling ring 14. Rigidly secured to the nose 15 of tool arm 12 is the upper surface of a gripping platen or jaw 16. Pivotally connected to the tool arm 12 as at 17 is a swingable arm 18 which carries at its forward end another gripping platen or jaw 19 which is movable into flat apposed relationship with the gripping platen or jaw 16 in the manner best seen in FIG. 3. The swingable arm 18 is operated in the manner usual with locking plier devices by means of the toggle arm 20 pivotally connected to the rear of the arm 18 by the pivot 21.

Figure 2:
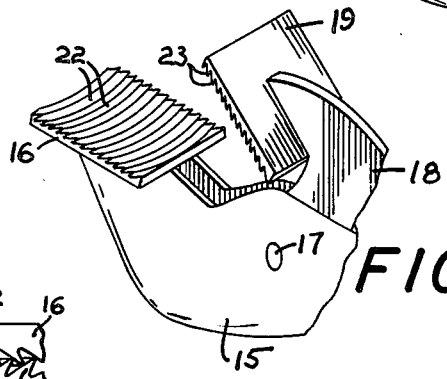
FIG. 2 is an isometric view of the head of the gripping tool, showing an inverted view of the platens or jaws shown in FIG. 1.
Figure 3:
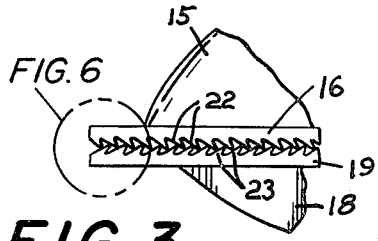
FIG. 3 is a fragmentary side view of the gripping head of the tool according to the invention showing the gripping jaws or platens in face to face apposition and engaged with one another.
Figure 6:
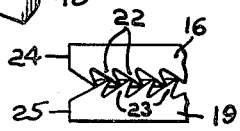
FIG. 6 is an enlarged fragmentary view of the internested teeth or serrations structures of the gripping tool as shown within the phantom circle on FIG. 3.
Figure 4:
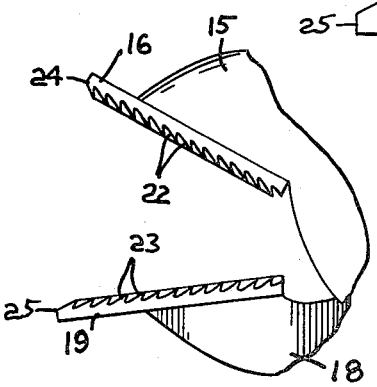
FIG. 4 is a fragmentary view on an enlarged scale of the gripping jaws of the gripping tool with the platens open and out of engagement with one another.

Each of the gripping platens 16 and 19 are formed on their apposed surfaces with arcuate teeth or serrations, being designated on the platen 16 by the reference character 22 and on the gripping platen 19 by the reference character 23. As best seen in FIGS. 1 and 2, the serrations 22 and 23 are arcuate in shape and run parallel to one another with the arcs shaped so that the centers of curvature lie substantially in the plane of the tool arms 12, 18 and 20 and in front of the free ends 24 and 25 of the gripping platens 16 and 19 respectively. As best seen in FIGS. 3, 4 and 6, the teeth or serrations 22 and 23 are angled rearwardly away from the free ends 24 and 25 of the gripping platens 16 and 19, with the teeth 22 internested with the teeth 23.

Figure 5:
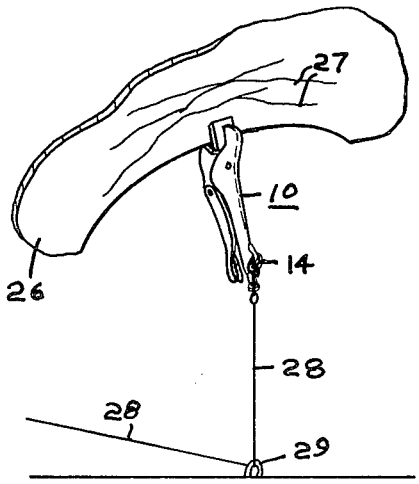
FIG. 5 illustrates the gripping tool according to the invention grippingly engaged with a piece of sheet metal and with the opposite end of the gripping tool secured by a pulling cable.

Referring now to FIG. 5, there is seen a portion of a piece of sheet metal 26 having wrinkles or bends 27 in it and to which is clampingly attached the gripping tool 10. A cable 28 is hooked into the pulling ring 14 at one end and has its opposite end passed downward through a floor anchor 29 from which it extends to the left for securement to a winch (not shown). The piece of sheet metal 26 could for example be a portion of an automobile fender or the floor of an automobile trunk or any other piece of dented or wrinkled sheet metal. The strong force exertable by the winch through the cable 28 causes the gripping tool 10 to be pulled in such a direction as to straighten out the wrinkles in the sheet metal. It is the tenacious grip of the gripping tool platens which permits such strong pulling forces to be exerted without having the locking plier pull loose from the sheet metal. As previously pointed out, each of the platens 16 and 19 may be on the order of an inch and a half square, but could be somewhat smaller or somewhat larger depending upon the particular application of intended use.

Having now described my invention in connection with a particularly illustrated embodiment thereof it will be apparent that variations and modifications of the invention may now naturally occur from time to time to those persons normally skilled in the art without departing from the essential scope or spirit of the invention, and accordingly it is intended to claim the same broadly as well as specifically as indicated by the appended claims.

What is claimed to be new and useful is:

1. A plier type gripping tool comprising in combination, (a) a first tool arm having rigidly secured to one end a first gripping platen having a free end, (b) a second tool arm having rigidly secured to one end a second gripping platen having a free end, (c) means interconnecting said first and second tool arms so that said first and second gripping platens are swingable with respect to one another between a spaced apart condition and an apposed condition in which the gripping faces of said platens are in planer apposed and contactable relationship with one another with the said free ends of said platens defining one end of said gripping tool, (d) a plurality of arcuate teeth or serrations on each of said platens, the centers of curvature of at least some of said teeth or serrations on each said platen being located in front of the free end of said platen.

2. A gripping tool as described in claim 1 wherein said plurality of arcuate teeth on each of said platens are parallel to one another.

3. A gripping tool as described in claim 1 wherein said plurality of arcuate teeth on each of said platens are parallel to one another, and the successive spacing of the teeth on one platen is the same as the successive spacing of the teeth on the other platen.

4. A gripping tool as described in claim 1 wherein at least some of said arcuate teeth on each said platen are set at an angle so as to point away from the said free end of said platen.

5. A gripping tool as described in claim 1, 2, 3 or 4 wherein each of said plurality of arcuate teeth is continuous across the face of said platen.

6. A gripping tool as described in claim 1, 2, 3 or 4 wherein said plurality of arcuate teeth on one of said platens internest with said plurality of arcuate teeth on the other of said platens when said platens are in said opposed and contactable relationship with one another.

7. A gripping tool as described in claim 5 wherein said plurality of arcuate teeth on one of said platens internest with said plurality of arcuate teeth on the other of said platens when said platens are in said opposed and contactable relationship with one another.

* * * * *